United States Patent [19]

Hickling

[11] Patent Number: 4,467,888

[45] Date of Patent: Aug. 28, 1984

[54] WORK PLATFORM FOR BUILDINGS

[75] Inventor: Richard C. Hickling, Stourport-on-Severn, England

[73] Assignee: HiRiser Limited, Stourport-on-Severn, England

[21] Appl. No.: 356,731

[22] Filed: Mar. 10, 1982

[30] Foreign Application Priority Data

Mar. 12, 1981 [GB] United Kingdom ..... 8107795

[51] Int. Cl.[3] ..... E04G 3/10; E04G 3/16

[52] U.S. Cl. ..... 182/19; 182/113; 182/142

[58] Field of Search ..... 182/141, 142, 19, 113, 182/150, 143, 144, 145, 146, 147, 148, 149, 130; 187/6, 16, 51

[56] References Cited

U.S. PATENT DOCUMENTS

| | | | |
|---|---|---|---|
| 494,328 | 3/1893 | Ennis | 182/142 |
| 1,403,420 | 1/1922 | Kohler | 187/51 |
| 2,433,763 | 12/1947 | Kiesling | 187/51 |
| 3,837,428 | 9/1974 | Gish | 182/142 |
| 4,018,306 | 4/1977 | Lyons | 182/142 |
| 4,293,054 | 10/1981 | Pieri | 182/148 |

FOREIGN PATENT DOCUMENTS

| | | | |
|---|---|---|---|
| 2037705 | 3/1980 | United Kingdom | 182/142 |

*Primary Examiner*—R. P. Machado
*Assistant Examiner*—Alvin Chin-Shue
*Attorney, Agent, or Firm*—Staas & Halsey

[57] ABSTRACT

A work platform for buildings having a guard rail having, at one end, a movable part pivotally mounted for movement about a horizontal axis between a working position and an upright safety position the guard rail including a mechanism carrying switch means arranged in the working position of the said movable part to be positioned to contact a member on an adjacent platform to control a circuit to stop the platform moving in a vertical direction and the movable part being controlled by said mechanism which also positions said switch means to prevent the platform passing one another when the end frame movable part is in any position except the safety position.

12 Claims, 7 Drawing Figures

WORK PLATFORM FOR BUILDINGS

Figure 1:
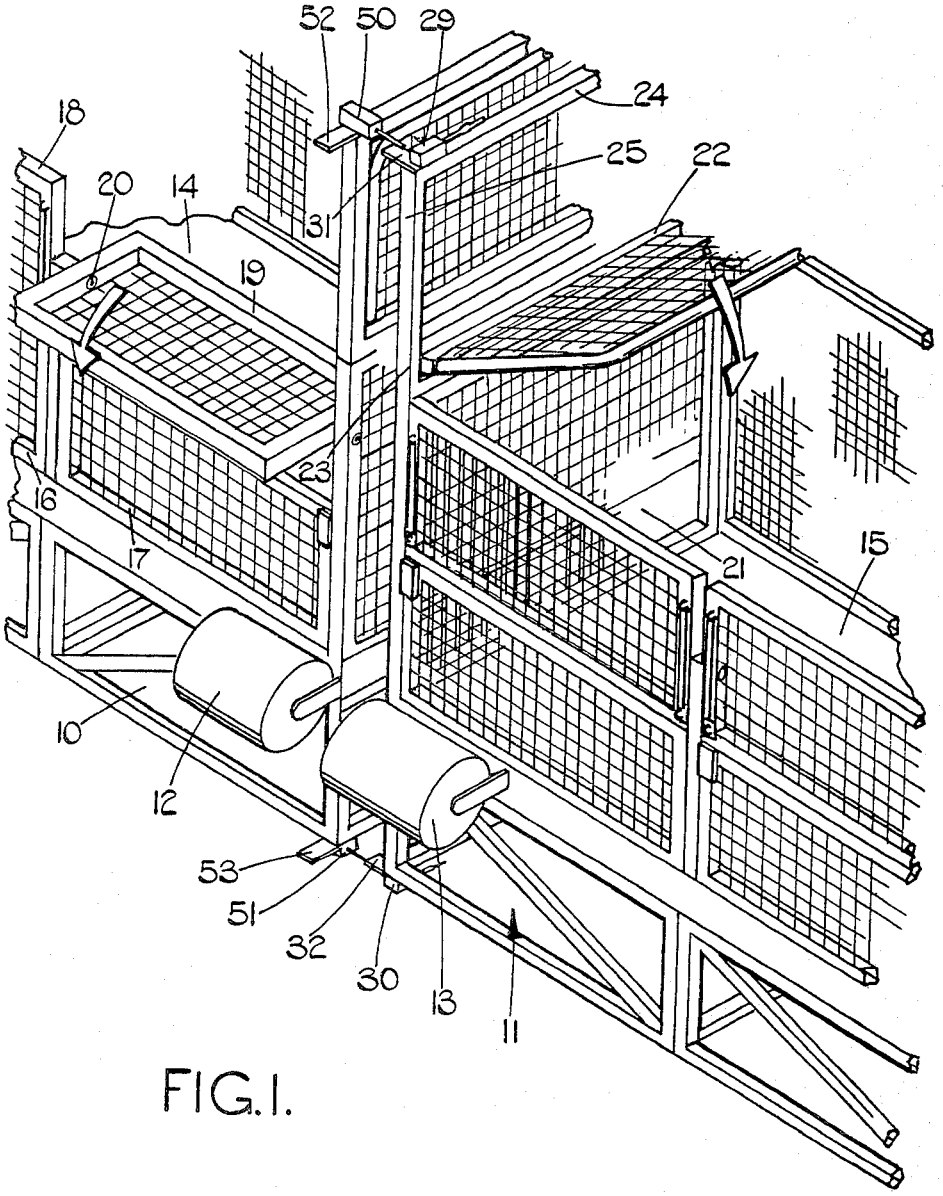

This invention relates to work platforms particularly for working on the exteriors of multistory blocks of offices or flats.

There are in existance a number of platform systems which can be moved up and down a building face to allow work to be carried out on the exterior of the building. These are more practical than conventional scaffolding structures since the latter are too time consuming to assemble and dismantle on high buildings and have too many components to be safe over a certain height. Suspended gondolas have certain uses but are not very stable as work platforms.

Therefore it has been proposed to mount a platform on a tower or mast which is relatively easily erected beside a building and which enables the platform to be quite stably supported, the mast itself being secured at intervals up the side of the building. This principle has been used for conveying materials in a cage to an upper level, simply therefore being used as a hoist, but only recently has this arrangement been used for a work platform.

In order to enable a whole face of a building to be accessible, for example so that modifications can be made to all windows, two or more masts may be set up with a work platform on each. The platforms are worked independantly and the danger therefore exists that if a workman is working over the lateral end of one platform when an adjacent platform is being moved past the same end, injury may occur, because the workman on the stationary platform may not see or hear the other one approaching and the workman on the moving platform may not be in a position to see the other platform.

One solution to this problem is to ensure adequate spacing between the adjacent platforms but this may leave a section of the wall inaccessible from either platform.

It is the object of this invention to provide a work platform for buildings in which adequate provision is made for protection against injury resulting from the passing of two adjacent platforms on a building.

According to the present invention there is provided a work platform for buildings, having a guard rail at least at one end, characterised in that the guard rail has a movable part, the movement of the part between a working and a safety position being arranged to operate a mechanism connected to switch means, the switch means being operative, when the movable part of the guard rail is in its safety position, so as to engage another platform and the switch means being connected in a circuit to stop the movement of the platform.

In a preferred arrangement, the mechanism connected to the switch means also carries a member, which, when the switch means is rendered inoperative, takes up a position to lie in the path of a similar switch means on an adjacent platform, to cause that switch means to be operated to stop said adjacent platform.

Conveniently the movable part of the guard rail is pivoted to a fixed section carrying said mechanism which automatically moves the switch means when the part is moved between working and safety positions.

Advantageously the mechanism includes a vertical angularly movable member carrying the switch means. Preferably this arrangement has switch means and members to contact adjacent platform switch means on its top and bottom ends, to be movable simultaneously into the alternative positions as the guard rail part moves.

In this context the expression guard rail is to be taken to include not only individual bar type rail sections, but frames and other structures having guarding functions.

The invention will now be described by way of example with reference to the accompanying drawings in which;

FIG. 1 is a perspective view showing parts of two adjacent platforms incorporating guard rail mechanisms constructed in accordance with the invention.

Figure 2:
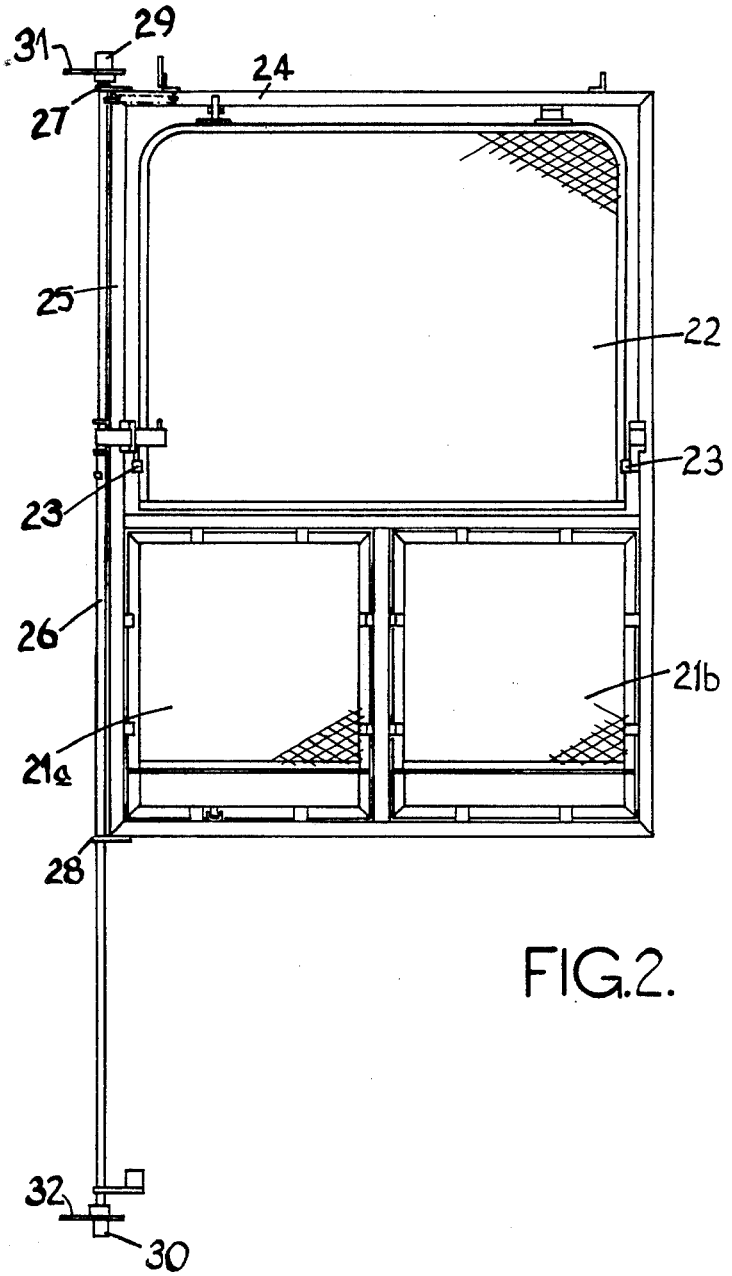
Figure 3:
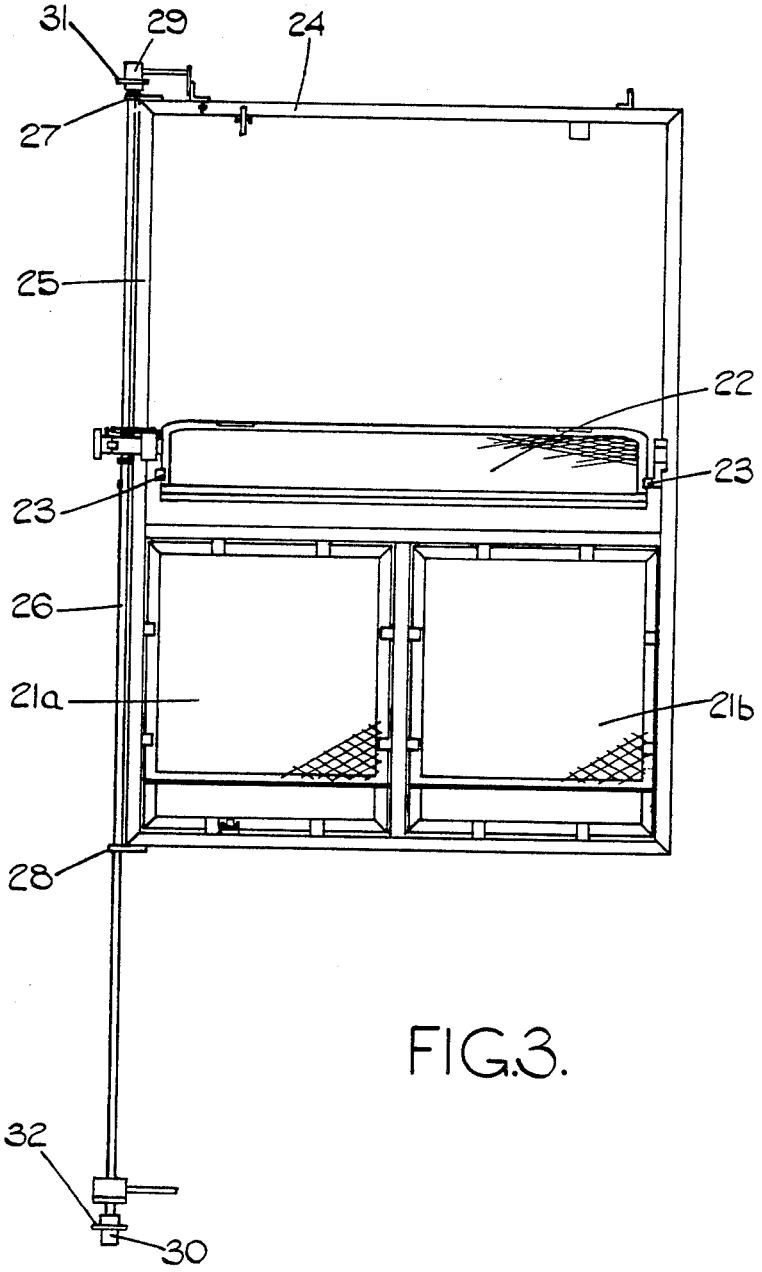
Figure 4:
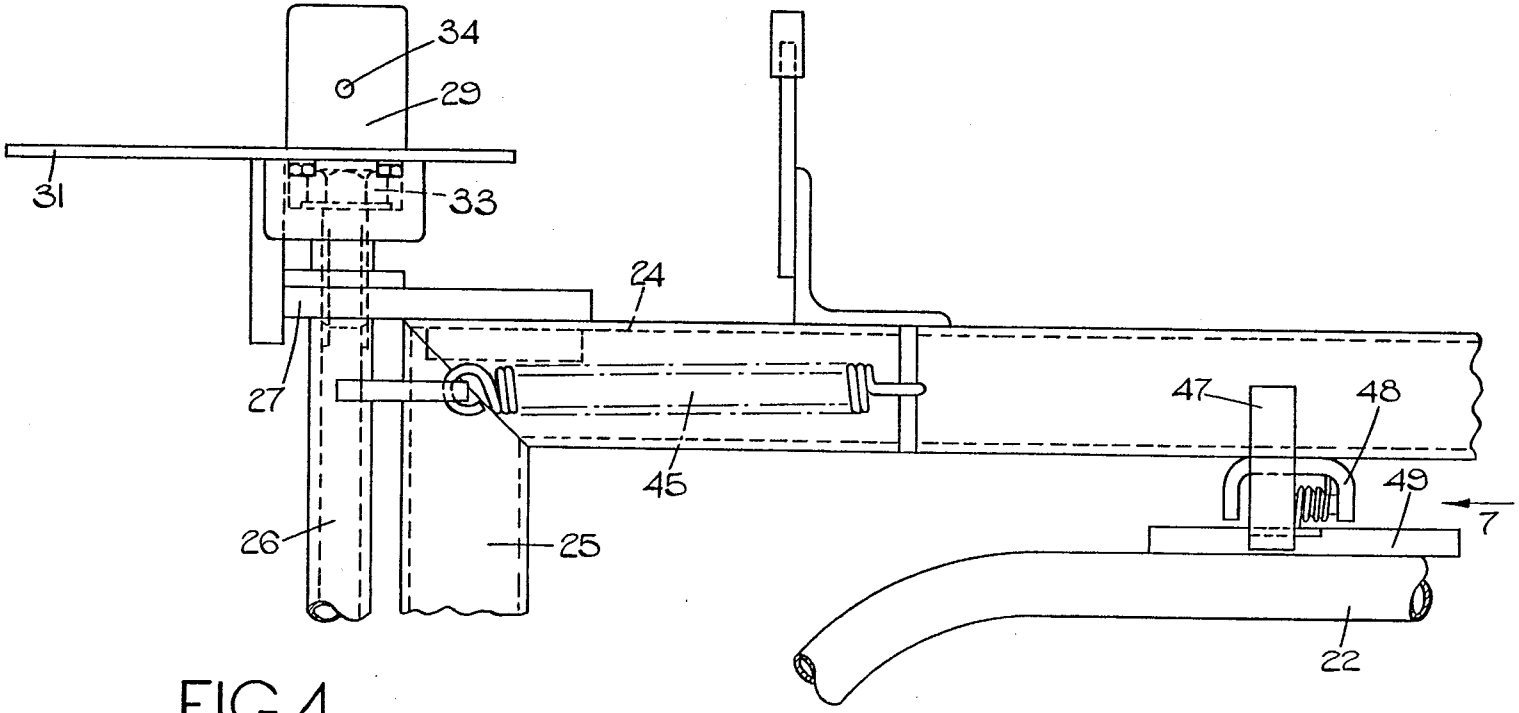
Figure 5:
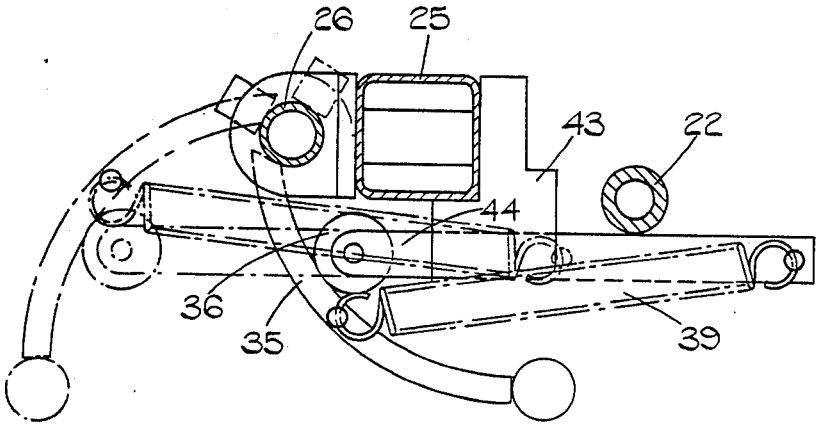
Figure 6:
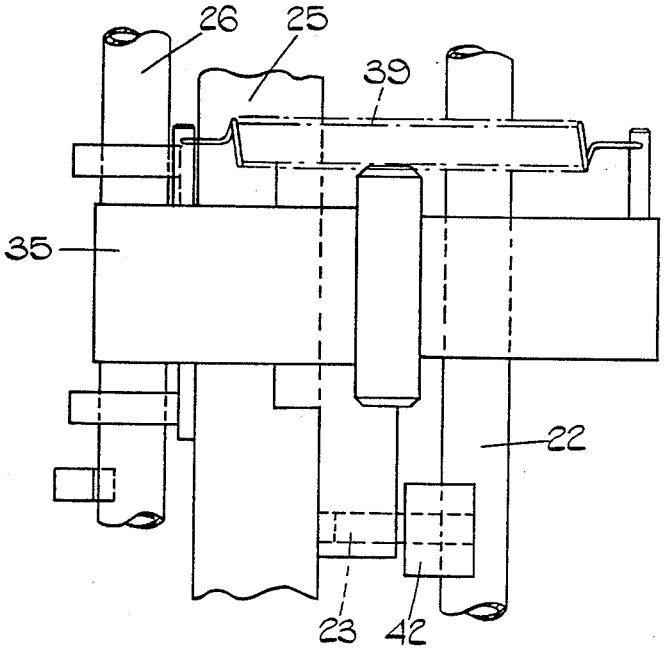
Figure 7:
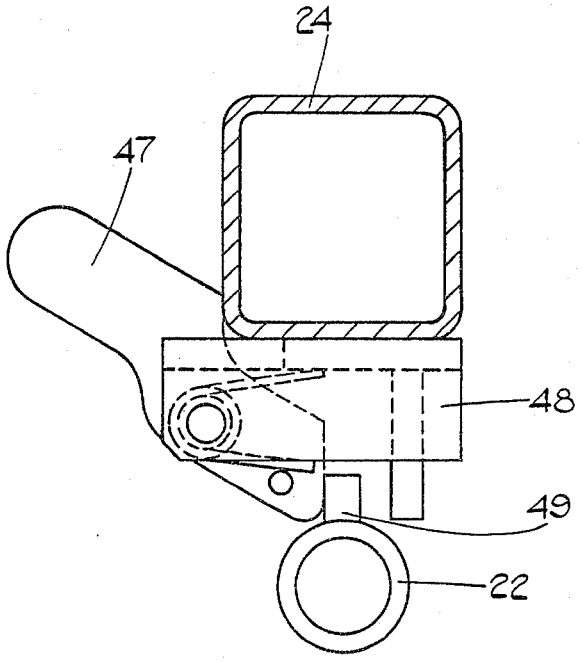

FIG. 2 is an enlarged view of an end frame guard rail mechanism shown in one position, FIG. 3 is a similar view but showing the guard rail mechanism in an alternative position, FIG. 4 is a side view of part of the mechanism on a larger scale, FIG. 5 is a plan view of an interlock forming part of the mechanism, in a safety position, FIG. 6 is a side elevation view of the part of the mechanism shown in FIG. 5 and FIG. 7 is a detail view of part of the mechanism as viewed in the direction of arrow 7 in FIG. 4.

FIG. 1 shows two platforms indicated generally at 10 and 11. These are of the kind intended to be mounted on respective masts secured at intervals to a building face. The masts are so spaced that adjacent ends of the two platforms are close together, as shown, with a small gap between them. FIG. 1 shows the faces of two platforms which are presented to the building face. The platforms carry respective rollers 12, 13 which can engage the building face, these aiding stability of the ends of the platform in use. The platforms are made up from a series of bars or tubes. Each platform defines a generally rectangular deck 14, 15 surrounded by an upright guard rail assembly to which further reference will be made. Under the deck 14 or 15 there is a strengthening structure of bars or tubes. Below the platform is mounted a motor drive assembly (not shown) by means of which the platform can be driven up and down the mast. Conveniently such drive takes place through a rack and pinion drive mechanism and appropriate switches, and brakes are provided to ensure safety of operation.

The guard rails are made up from respective frames containing safety wire mesh. There are fixed and movable frames on the sides presented to the building face and also at the ends. On the platform 10 the side presented to the building face has two fixed guard rail frames 16, 17 shown and two movable guard rail frames 18, 19 above these respectively. The guard rail frame 18 is in its upright position, generally coplanar with the fixed guard rail frame 16 beneath it. However, the guard rail frame 19 above the fixed guard rail frame 17 has been swivelled into a horizontal position about the pivots 20 situated in the centres of the two ends of such guard rail frame. The frame 19 has its edge extending towards the building face. This therefore minimises the gap between the building face and the platform to catch any tools or materials which may be dropped.

The end of the platform 11 has a fixed guard rail frame 21 and above this a movable guard rail frame 22. This is hinged at its lower end about a pivot pin 23. The movable frame 22 at the end of the platform is housed in its upright position within a rectangular hollow frame 24 which is fixed to the remainder of the platform. The corner post 25 of this is the corner post of the whole platform.

FIGS. 2 and 3 show a different arrangement in which two fixed frames 21*a*, 21*b* are mounted below a single movable frame 22. The movable frame 22 is provided with rounded upper corners and pivot pins 23 are positioned slightly differently from that in the FIG. 1 version, near the lower edge, and engaging in the fixed frame which includes the corner post 25.

Also carried by the corner post 25 is a rotatable vertical bar 26 mounted in journals 27, 28 at top and bottom of the corner post 25. The bar 26 extends below the corner post 25 as shown. At the top and at the bottom of this bar 26 are respective switches 29, 30 and stop plates 31, 32.

FIG. 4 shows the upper end of the bar 26 mounted in the journal 27 on the upper end of the corner post 25. Secured by a nut 33 at the upper end of the bar 26 is the assembly comprising the switch 29 and stop plate 31. The switch includes a block having a finger 34 projecting from it. The finger is deflectable and when deflected in any direction beyond a predetermined angle it actuates an electical contact within the switch block to open a circuit connected through the switch. The finger 34 is spring loaded to return to its normal position as shown.

The stop plate 31 is rectangular or as shown, assymmetric and is secured to the switch block by screws. The finger 34 of the switch 29 extends at right angles to the major dimension of the stop plate 31 as indicated in FIG. 4. However rotation of the vertical bar 26 through 90° in a clockwise direction moves the stop plate and the switch finger together through 90°. It will be appreciated that the switches 29, 30 at the top and at the bottom of the bar 26 have their respective fingers aligned and the stop plates 31, 32 are also aligned so that rotation of the vertical bar 26 causes simultaneous alteration of the positions of both switches and both stop plates.

When there is vertical movement of two adjacent platforms towards one another on their respective masts, it is necessary, to prevent accident, to ensure that the platforms cannot pass one another unless the movable frames 22 of the end guard rails are in their upright or safety positions. In such positions it is not possible for a workman to leave tools or to have any part of himself outside the end of the platform. To ensure that the switches 29, 30 or the stop plates 31, 32 are in correct positions there is an interlock mechanism shown in FIGS. 5 and 6 between the corner post 25, the vertical bar and the movable frame 22.

The interlock mechanism includes a hand lever 35 fixed to the vertical bar 26 and arranged to rotate the bar when swung between the two positions indicated in FIG. 5.

This hand lever 35 is an arcuate plate with a handle at the outer end and on which runs a roller 36 mounted in a forked end of a sliding locking bar 44. This locking bar 44 slides in a bracket 43 which serves as a guide for it and is fixed to the corner post 25. The bracket 43 is generally L shaped in plan as shown in FIG. 5. The sliding locking bar 44 is above the hinge pin 23 as seen in FIGS. 2, 3 and 6. A tension spring 39 is connected between the ends of the locking bar 44 remote from the roller 36 and a pin on the hand lever 35 part way along its length. This serves to keep the roller 36 in contact with inside curved surface of the hand lever 35 at all times. Further springs 45 at the top and bottom of the vertical bar 26 and connected to the fixed frame 24 urge the vertical bar 26 towards the closed position of FIGS. 5 and 6. In this example the movable frame 22 is made up from tubular metal with mesh attached to it and the pivot pin 23 is journalled in a block 42 fixed to the side of the frame 22.

When moving between safety and working positions the movable frame, as indicated in FIG. 2, moves from a vertical position substantially in line with the fixed frames 21 below it and a further vertical position shown in FIG. 3 in which it lies alongside the fixed frames 21. Rotation takes place about the axis of the pivot pins 23. In the closed or safety position of FIG. 2 the locking bar 44 protrudes into the path of the frame 22 to prevent any substantial travel towards the open or working position. The hand lever 35 is however moved to allow the locking bar 44 to withdraw to the left as seen in FIG. 5 to the position indicated in dotted lines in FIG. 5 in which the frame 22 can pass its end. In the closed or safety position, the switch finger 34 is presented outwardly but in the open or working position the stop plate 31 is presented outwardly instead. The frame 22 in the working position is aligned with the locking bar 44 so that this cannot return to its locked position without movement of the frame 22 first having taken place and similarly the locking bar 44 cannot be moved to the open or closed positions without accompanying movement of the switches taking place.

The interlock system is therefore such that it is not possible to move the vertical rod 26 without moving the movable frame 22 of the guard rail so that an operator cannot move the switches to inappropriate positions when the guard rail is in the open or working position, as shown in FIG. 3.

It is possible to replace the mechanism shown with a simpler bar rotatable with the vertical rod 26 and movable between a position locking the movable frame 22 in its upright position as shown in FIG. 2 to a position in which it is clear from that frame, to allow it to swing down, as shown in FIG. 3.

An interlock switch (not shown) may be fitted to provide that the whole platform cannot be moved until the frame 22 is in its upright or safety position. This is preferably attached to the top bar of the fixed frame 24. A catch 47 shown in FIGS. 4 and 7 is also fitted to hold the movable frame 22 in its upright position. This is pivoted in a bracket 48 and is spring loaded towards the latched position in which it will engage with a detent 49 on the top bar of the frame 22.

Referring again to FIG. 1 it is seen that both platforms 10 and 11 have switches and stop plates at top and bottom of their adjacent corners. As illustrated the stop plates 31, 32 on the platforms 11 are in operative positions whereas the switches 29, 30 are rendered inoperative. On the contrary switches 50, 51 on the platform 10 are in operative positions aligned with the respective stop plates 31 and 32 whereas stop plates 52, 53 on the platform 10 are rendered inoperative.

If the platform 10 is moved, its switches will contact the stop plates or either of them, on the platform 11 thus arresting movement of the platform 10 through appropriate electrical circuits. Thus, it is not possible for the platform 10 to move past the platform 11 when the latter has its end movable frame 22 in any position other than the safety position. If the frame 22 is in the safety position, the switch fingers of the two platforms will be presented towards one another and no switching will occur on either platform. However where a stop plate is in alignment with a switch, the apprpriate platform movement will be arrested, to prevent accident.

The movable frames on the side of each platform which are presented towards the building face may also include interlock mechanisms to prevent these frames being left in working positions when the platform is moved.

Other forms of interlock mechanism and switching may be provided but the principle is maintained that it is not possible for one platform to move past another where an end frame on that other platform is in a position other than its safety position. Free movement of the platforms relatively to each other on their respective masts is however possible when all frames are in safety positions. It is also not possible for a workman to override the safety arrangements by operating the interlock mechanism without moving the movable frames.

I claim:

1. A movable work platform, the platform including:
   - a guard rail positioned at least at one end of the platform, said guard rail including a movable guard rail part being movable between a working position and a safety position;
   - switch means for preventing movement of the platform; and
   - interlock means, operatively connected to said switch means and to said movable guard rail part, for rendering said switch means incapable of being operated by an adjacent platform when said movable guard rail is in said working position and for rendering said switch means capable of being operated by the adjacent platform when said movable guard rail is in said safety position, such that the movement of the adjacent platform is stopped when engaging the platform having said movable guard rail part in said working position.

2. A work platform as claimed in claim 1 characterised in that the interlock means connected to the switch means also includes a member which, when the switch means is rendered incapable of operation, takes up a position to lie in the path of a similar switch means on the adjacent platform so as to cause the similar switch means to be actuated to stop the adjacent platform.

3. A work platform as claimed in claim 1, in which said switch means and a member of said interlock means are carried on a vertically rotatable bar and are arranged to extend in mutually right angular positions to one another, such that rotation of the bar through 90° moves the switch means and said member between two alternative positions, extending outwardly of the end of the platform.

4. A work platform as claimed in claim 3 characterised in that the bar carries a switch means and a member of said interlock means at its upper and at its lower ends.

5. A work platform as claimed in claim 3, or claim 4 characterised in that the switch means has a flexible operating finger and the member is a plate mounted horizontally to be engageable by the switch finger on the adjacent platform when they are in appropriate respective positions.

6. A work platform as claimed in claims 1, 2, 3 or 4, wherein the movable part of the guard rail is pivoted to a fixed section carrying the interlock means which automatically moves the switch means when the part is moved between the working and the safety positions.

7. A work platform as claimed in claim 3 characterised in that the interlock means includes a lever which is connected to the vertically rotatable bar and has a locking bar movable in conjunction with the lever and in one position blocks the movement of said movable part and in an alternative position allows such movable part to move.

8. A work platform as claimed claims 1, 2, 3 or 7 the movable part is pivotally mounted about a horizontal axis and has a releasable catch device to secure it in an upright position which is its safety position.

9. A work platform as claimed in claim 2, wherein said switch means and said member are carried on a vertically rotatable bar and are arranged to extend in mutually right angular positions to one another, such that rotation of the bar through 90° moves said switch means and said member between two alternative positions, extending outwardly of the end of the platform.

10. A movable work platform, the platform including;
   - a guard rail positioned at least at one end of the platform, said guardrail including a movable guardrail part being movable between a working position and a safety position;
   - a movable stop member;
   - switch means for preventing movement of the platform; and
   - interlock means, operatively connected to said movable stop member and to said movable guardrail part, for rendering said movable stop member capable of operating an adjacent switch means of an adjacent platform when said movable guardrail part is in said working position, and for rendering said movable stop member incapable of operating said adjacent switch means of said adjacent platform when said movable guardrail part is in said safety position.

11. A movable work platform according to claim 10, wherein said switch means is activated by a movable stop member of said adjacent platform such that movement of the platform is inhibited.

12. A movable work platform according to claim 1, 2, 3, 10 or 11 wherein said interlock means further comprises a limit switch means for inhibiting movement of the platform when the movable guardrail part of the platform is in said working position.

* * * * *